United States Patent [19]

Greenspoon et al.

[11] Patent Number: 4,688,462

[45] Date of Patent: Aug. 25, 1987

[54] TAMBOURINE

[76] Inventors: Michael Greenspoon, Hamayan Street 10, Givataim; Asher I. Greenspoon, Einstein Street 75, Tel-Aviv, both of Israel

[21] Appl. No.: 888,055

[22] Filed: Jul. 22, 1986

[30] Foreign Application Priority Data

Jul. 26, 1985 [IL] Israel ..... 75922

[51] Int. Cl.[4] ..... G10D 13/02

[52] U.S. Cl. ..... 84/418

[58] Field of Search ..... 84/418, 410

[56] References Cited

U.S. PATENT DOCUMENTS

| | | | |
|---|---|---|---|
| 2,472,408 | 6/1949 | Di Angelo | 84/418 X |
| 3,657,465 | 4/1972 | Koishikawa | 84/418 |
| 3,675,528 | 7/1972 | Brick | 84/418 |

*Primary Examiner*—Lawrence R. Franklin

*Attorney, Agent, or Firm*—Benjamin J. Barish

[57] ABSTRACT

A tambourine comprises a shell carrying a plurality of jingle discs, characterized in that the shell further carries a hollow resonator box effecting internal resonant oscillation of the sounds produced by the jingle discs. The hollow resonator box includes an opening which is selectively closable by the user for selectively producing different sound pitches.

20 Claims, 9 Drawing Figures

FIG 1
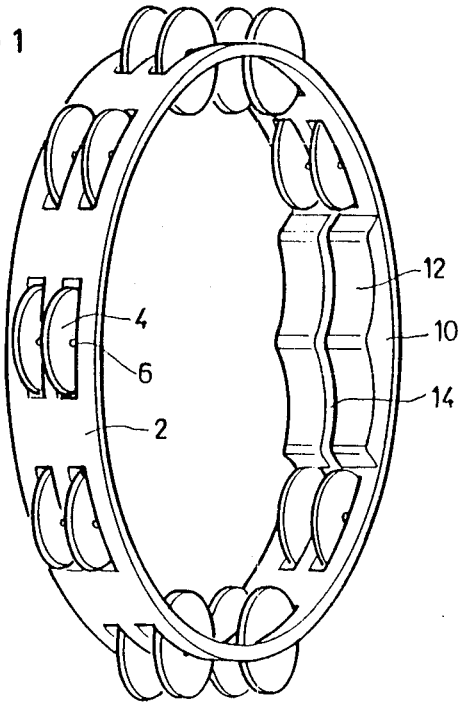
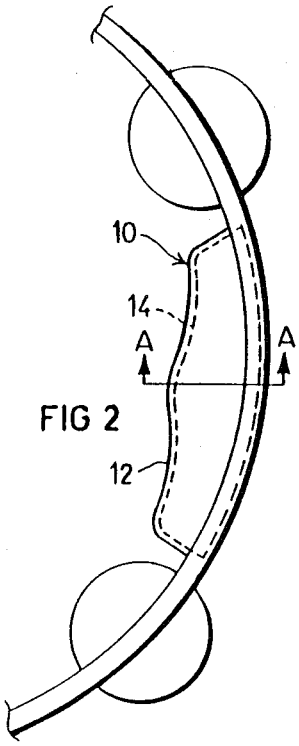
FIG 2
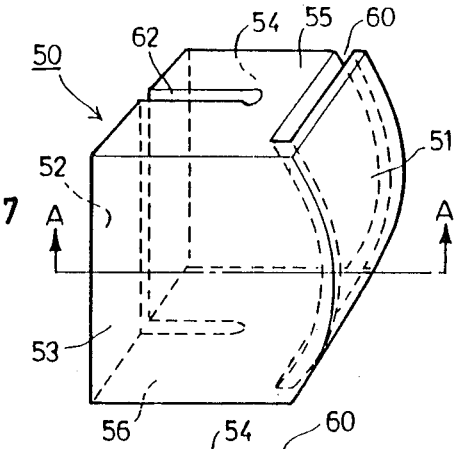
FIG 7
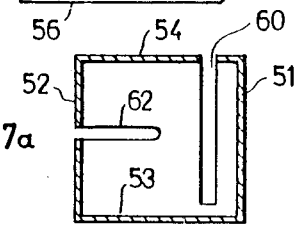
FIG 7a

TAMBOURINE

BACKGROUND OF THE INVENTION

The present invention relates to tambourines, namely to muscial instruments including a shell carrying a plurality of jingle discs, which shell is shaken with one hand and/or struck with the other in order to produce musical sounds.

SUMMARY OF THE INVENTION

According to a broad aspect of the present invention, there is provided a tambourine comprising a hoop-shaped shell carrying a plurality of jingle discs, characterized in that the shell further carried a hollow resonator box effecting internal resonant oscillation of the sounds produced by the jingle discs.

In the preferred embodiments of the invention described above, the hollow resonator box includes an opening which is selectively closable by the user for selectively producing different sound pitches.

Hollow resonator boxes have been used with tuning forks in which the hollow resonator box is dimensioned so that the air inside the box has a natural period of vibration equal to that of the tuning fork. Also known are Helmholtz resonators consisting of a brass shell of approximately spherical form with a large opening at one end and a small opening at the opposite end. However, in so far as we are aware, resonator boxes have not heretofore been proposed for tambourines.

We found that a tambourine constructed to include a hollow resonator box as set forth above produces sounds of particularly pleasing qualities.

Several embodiments of the invention are described below for purposes of example. Thus, according to the described embodiments, the opening in the hollow resonator box may include an elongated slot, a circular opening, both an elongated slot and a circular opening, or a plurality of circular openings.

In some described embodiments, the hollow resonator box is built into the shell of the tambourine; preferably, the outer configuration of the hollow resonator box is shaped to serve as a handgrip for the tambourine.

In another described embodiment, the hollow resonator box is in the form of an attachment attachable to the shell of the tambourine; the tambourine may be provided with a plurality of such hollow resonator boxes, each of different dimensions, selectively attachable to the tambourine shell to produce different musical effects.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a three-dimensional view illustrating one form of tambourine constructed in accordance with the present invention;

FIG. 2 is an enlarged, fragmentary view illustrating the portion of the tambourine constructed with the hollow resonator box;

FIG. 7 illustrates a hollow resonator box constructed in the form of a separate attachment attachable to the shell of a tambourine; and FIG. 7*a* is a sectional view along lines A—A of FIG. 7.

DESCRIPTION OF PREFERRED EMBODIMENTS

Figure 3:
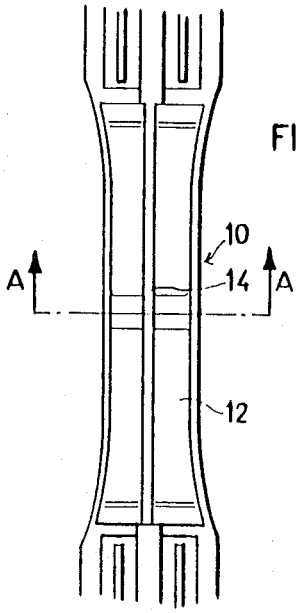
FIG. 3 is a side elevational view, from the inside of the tambourine, illustrating the hollow resonator box thereof.
Figure 3A:
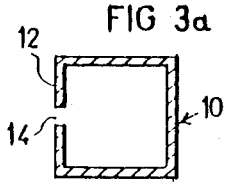
FIG. 3*a* is a sectional view along lines A—A of FIG. 2.

The tambourine illustrated in FIGS. 1 and 2 comprises a hoop-shaped shell 2 carrying a plurality of jingle discs 4. As in known tambourine constructions, the shell 2 is of circular configuration made of wood or plastic, and the jingle discs 4 are of metal freely mounted on pins 6 so as to produce jingling sounds when the tambourine is shaken with one hand and/or struck with the other.

In accordance with the present invention, the tambourine illustrated in FIG. 1 includes a hollow resonator box, generally designated 10, effecting internal resonant oscillations of the sounds produced by the jingle discs. In the embodiment illustrated in FIGS. 1 and 2, the hollow resonator box 10 is built into the shell 2 and has an outer configuration 12 along its inner face shaped to serve as a handgrip for the tambourine.

The hollow resonator box 10 is formed along its inner face with an elongated slot 14 which may be completely or partially closed by the user's hand when gripping the tambourine in order to vary the pitch of the sounds produced by the tambourine. Thus, if the user grips merely the sides of the hollow resonator box 10, leaving the elongated slot 14 open, one type of sound will be produced, and if the user completely or partially closes the elongated slot 14 with his fingers, the tambourine will produce sounds of different pitches. In this simple manner, therefore, the user can change the pitches of the sounds produced by the jingling of the discs 6 when the tambourine is shaken with one hand and/or struck with the other. It has been found that very pleasing sounds of different pitches can thus be selectively produced in this very simple manner.

Figure 4:
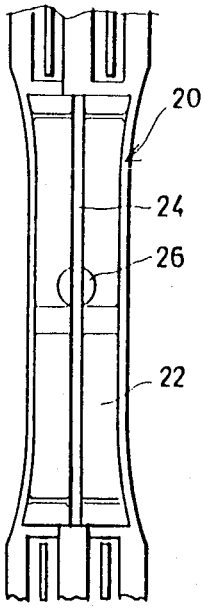
FIGS. 4, 5 and 6 are views similar to that of FIG. 3 but illustrating variations in the construction of the hollow resonator box.

FIG. 4 illustrates a variation in the construction of the hollow resonator box, therein designated 20, wherein the box is formed not only with an elongated slot 24, but also with a circular opening 26 which latter opening may also be selectively closed by the user's fingers in order to change the pitches of the sounds produced by the tambourine. The resonator box illustrated in FIG. 4 is otherwise constructed in the same manner as described above with respect to FIGS. 1–3 as part of the shell of the tambourine, including the handgrip 22, to enable the hollow resonator box also to serve as the handle for the tambourine.

Figure 5:
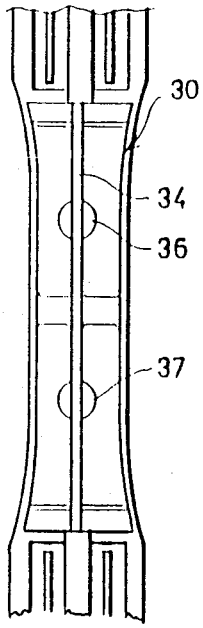

FIG. 5 illustrates a still further variation wherein the hollow resonator box, therein designated 30, also built into the shell of a tambourine and formed with a handgrip shaped surface, includes an elongated slot 34 and two circular openings 36, 37 spaced along the length of the box. The latter openings are also selectively closable by the user's fingers in order to selectively vary the pitches of the sounds produced by the tambourine.

Figure 6:
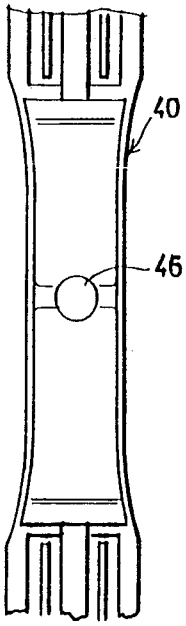

FIG. 6 illustrates a still further variation wherein the hollow resonator box, therein designated 40, is formed with a circular opening 46 (or a plurality of such openings if desired) instead of the elongated slot (14, 24 or 34) for use by the user in selecting the pitches of the sounds to be produced by the tambourine.

FIGS. 7 and 7*a* illustrated a still further variation, wherein the hollow resonator box, therein designated 50, is not built into the shell of the tambourine, as in the above-described embodiments of FIGS. 1–6, but rather is in the form of a separate attachment attachable to the shell of the tambourine.

In the embodiment illustrated in FIGS. 7 and 7*a*, the hollow resonator box 50 is substantially in the shape of a right rectangular prism, including a pair of end walls 51, 52, a pair of side wall 53, 54, a top wall 55, and a bottom wall 56. All the foregoing walls are substantially flat except for end wall 51, which latter wall is curved conforming to the curvature of the shell (e.g. 2, FIG. 1) of the tambourine to which the box is to be attached. The attachment of the box of the tambourine shell is effected by a slit 60 formed through one side wall 54 and through the top and bottom walls 55, 56 but terminating short of the other side wall 53. Slot 60 is dimensioned so that it can be conveniently applied by a press friction fit to the shell of the tambourine. If desired, a fastener, such as a threaded pin (not shown), may also be included in order to more firmly secure the hollow resonator box 50 to the tambourine shell.

As in the previously described embodiments, hollow resonator box 50 is dimensioned so as to effect internal resonant oscillations of the sounds produced by the jingle discs. The box is formed with an elongated slot 62 passing through the top and bottom walls 55, 56, and also through end wall 52, which slot serves as the opening for the resonator box determining the pitches of the sounds produced by the box.

Elongated slot 62 may also be of any of the configurations described above and illustrated in FIGS. 3–6, for example, which are selectively closable by the user in order to vary the pitches produced by the box. However, in the embodiment described in FIGS. 7 and 7*a*, rather than selectively closing the box opening to vary the pitches, it is preferred to provide tambourine with a plurality of different hollow resonator boxes, each similar to box 50 illustrated in FIGS. 7 and 7*a* but differently dimensioned, or formed with slot 62 of different configurations or dimensions, so as to vary the pitches produced by the tambourine.

While the invention has been described with respect to a tambourine not including a drumhead, it will be appreciated that the invention, particularly the embodiment of FIGS. 1–6, could be used with drumhead-type tambourines. Also, while the tambourine illustrated in the drawings is of the type including a shell of circular configuration, it will be appreciated that the invention could also be used with tambourines having half-moon shells, or shells of other configurations.

Many other variations, modifications and applications of the invention will be apparent.

What is claimed is:

1. A tambourine comprising a hoop-shaped shell carrying a plurality of jingle discs, characterized in that said shell further carries a hollow resonator box effecting internal resonant oscillation of the sounds produced by said jingle discs.

2. The tambourine according to claim 1, wherein said hollow resonator box includes an opening which is selectively closable by the user for selectively producing different sound pitches.

3. The tambourine according to claim 2, wherein said opening in the hollow resonator box includes an elongated slot.

4. The tambourine according to claim 2, wherein said hollow resonator box includes a circular opening.

5. The tambourine according to claim 2, wherein said opening in the hollow resonator box includes both an elongated slot and a circular opening.

6. The tambourine according to claim 2, wherein said opening in the hollow resonator box includes a plurality of circular openings.

7. The tambourine according to claim 1, wherein said hollow resonator box is built into said shell.

8. The tambourine according to claim 7, wherein the outer configuration of said hollow resonator box is shaped to serve as a handgrip for the tambourine.

9. The tambourine according to claim 1, wherein said hollow resonator box is in the form of an attachment attachable to the shell of the tambourine.

10. The tambourine according to claim 9, wherein there are a plurality of said hollow resonator boxes, each of different dimensions, selectively attachable to the shell of the tambourine.

11. A tambourine comprising a hoop-shaped shell carrying a plurality of jingle discs, characterized in that said shell further carries a hollow resonator box effecting internal resonant oscillation of the sounds produced by said jingle discs, said hollow resonator box being shaped to serve as a handgrip for the tambourine.

12. The tambourine according to claim 11, werein said hollow resonator box includes an opening which is selectively closable by the user for selectively producing different sound pitches.

13. The tambourine according to claim 12, wherein said opening in the hollow resonator box includes an elongated slot.

14. The tambourine according to claim 12, wherein said hollow resonator box includes a circular opening.

15. The tambourine according to claim 12, wherein said opening in the hollow resonator box includes both an elongated slot and a circular opening.

16. The tambourine according to claim 12, wherein said opening in the hollow resonator box includes a plurality of circular openings.

17. The tambourine according to claim 11, wherein said hollow resonator box is built into said shell.

18. A tambourine comprising a hoop-shaped shell carrying a plurality of jingle discs, characterized in that said shell further carries a hollow resonatar box effecting internal resonant oscillation of the sounds produced by said jingle discs, said hollow resonator box being in the form of an attachment attachable to the shell of the tambourine.

19. The tambourine according to claim 18, wherein said hollow resonator box includes an opening which is selectively closable by the user for selectively producing different sound pitches.

20. The tambourine according to claim 18, wherein there are a plurality of said hollow resonator boxes, each of different dimensions, selectively attachable to the shell of the tambourine.

* * * * *